US007628339B2

(12) United States Patent
Ivri et al.

(10) Patent No.: US 7,628,339 B2
(45) **Date of Patent: *Dec. 8, 2009**

(54) SYSTEMS AND METHODS FOR CONTROLLING FLUID FEED TO AN AEROSOL GENERATOR

(75) Inventors: Yehuda Ivri, Newport Beach, CA (US); Markus Flierl, Sunnyvale, CA (US)

(73) Assignee: Novartis Pharma AG, Basel (CH)

( * ) Notice: Subject to any disclaimer, the term of this patent is extended or adjusted under 35 U.S.C. 154(b) by 46 days.

This patent is subject to a terminal disclaimer.

(21) Appl. No.: 11/418,841

(22) Filed: May 5, 2006

(65) Prior Publication Data

US 2006/0255174 A1 Nov. 16, 2006

Related U.S. Application Data

(63) Continuation of application No. 10/394,512, filed on Mar. 21, 2003, now Pat. No. 7,040,549, which is a continuation-in-part of application No. 09/318,552, filed on May 27, 1999, now Pat. No. 6,540,153, which is a continuation of application No. 08/417,311, filed on Apr. 5, 1995, now Pat. No. 5,938,117, which is a continuation-in-part of application No. 08/163,850, filed on Dec. 7, 1993, now Pat. No. 6,629,646, which is a continuation-in-part of application No. 07/726,777, filed on Jul. 8, 1991, now abandoned, which is a continuation-in-part of application No. 07/691,584, filed on Apr. 24, 1991, now Pat. No. 5,164,740.

(51) Int. Cl.
*B05B 1/08* (2006.01)

(52) U.S. Cl. ..... 239/102.2; 239/69; 239/71; 239/338; 239/552; 128/200.16

(58) Field of Classification Search ..... 239/4, 239/102.1, 102.2, 71, 74, 128, 135, 136, 239/338, 596, 67, 69, 552; 128/200.14, 200.16
See application file for complete search history.

(56) References Cited

U.S. PATENT DOCUMENTS 550,315 A 11/1895 Allen (Continued)

FOREIGN PATENT DOCUMENTS

AU 1454597 9/1997

(Continued)

OTHER PUBLICATIONS

Abys, J.A. et al., "Annealing Behavior of Palladium-Nickel Alloy Electrodeposits," Plating and Surface Finishing, Aug. 1996, pp. 1-7.

(Continued)

*Primary Examiner*—Steven J Ganey
(74) *Attorney, Agent, or Firm*—Michael J. Mazza

(57) ABSTRACT

A method for controlling the supply of liquid to an aerosol generator comprises operating a liquid supply system to supply a liquid to a vibratable aperture plate of an aerosol generator which senses an amount of liquid adhering to the vibratable aperture plate, and controls operation of the liquid supply system to adjust the amount of liquid adhering to the vibratable aperture plate.

7 Claims, 8 Drawing Sheets

U.S. PATENT DOCUMENTS

| | | | | |
|---|---|---|---|---|
| 809,159 | A | | 1/1906 | Willis et al. |
| 1,680,616 | A | | 8/1928 | Horst |
| 2,022,520 | A | | 11/1935 | Philbrick |
| 2,101,304 | A | | 12/1937 | Wright |
| 2,158,615 | A | | 5/1939 | Wright |
| 2,187,528 | A | | 1/1940 | Wing |
| 2,223,541 | A | | 12/1940 | Baker |
| 2,266,706 | A | | 12/1941 | Fox et al. |
| 2,283,333 | A | | 5/1942 | Martin |
| 2,292,381 | A | | 8/1942 | Klagges |
| 2,360,297 | A | | 10/1944 | Wing |
| 2,375,770 | A | | 5/1945 | Dahlberg |
| 2,383,098 | A | | 8/1945 | Wheaton |
| 2,404,063 | A | | 7/1946 | Healy |
| 2,430,023 | A | | 11/1947 | Longmaid |
| 2,474,996 | A | | 7/1949 | Wallis |
| 2,512,004 | A | | 6/1950 | Wing |
| 2,521,657 | A | | 9/1950 | Severy |
| 2,681,041 | A | | 6/1954 | Zodtner et al. |
| 2,705,007 | A | | 3/1955 | Gerber |
| 2,735,427 | A | | 2/1956 | Sullivan |
| 2,764,946 | A | | 10/1956 | Henderson |
| 2,764,979 | A | | 10/1956 | Henderson |
| 2,779,623 | A | | 1/1957 | Eisenkraft |
| 2,935,970 | A | | 5/1960 | Morse et al. |
| 3,103,310 | A | | 9/1963 | Lang |
| 3,325,031 | A | | 6/1967 | Singier |
| 3,411,854 | A | | 11/1968 | Rosler et al. |
| 3,515,348 | A | | 6/1970 | Coffman, Jr. |
| 3,550,864 | A | | 12/1970 | East |
| 3,558,052 | A | | 1/1971 | Dunn |
| 3,561,444 | A | | 2/1971 | Boucher |
| 3,563,415 | A | | 2/1971 | Ogle |
| 3,680,954 | A | | 8/1972 | Frank |
| 3,719,328 | A | | 3/1973 | Hindman |
| 3,738,574 | A | | 6/1973 | Guntersdorfer et al. |
| 3,771,982 | A | | 11/1973 | Dobo |
| 3,790,079 | A | | 2/1974 | Berglund et al. |
| 3,804,329 | A | | 4/1974 | Martner |
| 3,812,854 | A | | 5/1974 | Michaels et al. |
| 3,838,686 | A | | 10/1974 | Szekely |
| 3,842,833 | A | | 10/1974 | Ogle |
| 3,865,106 | A | | 2/1975 | Palush |
| 3,903,884 | A | | 9/1975 | Huston et al. |
| 3,906,950 | A | | 9/1975 | Cocozza |
| 3,908,654 | A | | 9/1975 | Lhoest et al. |
| 3,950,760 | A | | 4/1976 | Rauch et al. |
| 3,951,313 | A | | 4/1976 | Coniglione |
| 3,958,249 | A | | 5/1976 | DeMaine et al. |
| 3,970,250 | A | | 7/1976 | Drews |
| 3,983,740 | A | | 10/1976 | Danel |
| 3,993,223 | A | | 11/1976 | Welker, III et al. |
| 4,005,435 | A | | 1/1977 | Lundquist et al. |
| 4,030,492 | A | | 6/1977 | Simbumer |
| 4,052,986 | A | | 10/1977 | Scaife |
| 4,059,384 | A | | 11/1977 | Holland et al. |
| D246,574 | S | | 12/1977 | Meierhoefer |
| 4,076,021 | A | | 2/1978 | Thompson |
| 4,083,368 | A | | 4/1978 | Freezer |
| 4,094,317 | A | | 6/1978 | Wasnich |
| 4,101,041 | A | | 7/1978 | Mauro, Jr. et al. |
| 4,106,503 | A | | 8/1978 | Rosenthal et al. |
| 4,109,174 | A | | 8/1978 | Hodgson |
| 4,113,809 | A | | 9/1978 | Abair et al. |
| D249,958 | S | | 10/1978 | Meierhoefer |
| 4,119,096 | A | | 10/1978 | Drews |
| 4,121,583 | A | | 10/1978 | Chen |
| 4,159,803 | A | | 7/1979 | Cameto et al. |
| 4,207,990 | A | | 6/1980 | Weiler et al. |
| 4,210,155 | A | | 7/1980 | Grimes |
| 4,226,236 | A | | 10/1980 | Genese |
| 4,240,081 | A | | 12/1980 | Devitt |
| 4,240,417 | A | | 12/1980 | Holever |
| 4,248,227 | A | | 2/1981 | Thomas |
| 4,261,512 | A | | 4/1981 | Zierenberg |
| D259,213 | S | | 5/1981 | Pagels |
| 4,267,976 | A | * | 5/1981 | Chatwin ..... 239/102.2 |
| 4,268,460 | A | | 5/1981 | Boiarski et al. |
| 4,294,407 | A | | 10/1981 | Reichl et al. |
| 4,298,045 | A | | 11/1981 | Weiler et al. |
| 4,299,784 | A | | 11/1981 | Hense |
| 4,300,546 | A | | 11/1981 | Kruber |
| 4,301,093 | A | | 11/1981 | Eck |
| 4,319,155 | A | | 3/1982 | Makai et al. |
| 4,334,531 | A | | 6/1982 | Reichl et al. |
| 4,336,544 | A | | 6/1982 | Donald et al. |
| 4,338,576 | A | | 7/1982 | Takahashi et al. |
| 4,368,476 | A | | 1/1983 | Uehara et al. |
| 4,368,850 | A | | 1/1983 | Szekely |
| 4,374,707 | A | | 2/1983 | Pollack |
| 4,389,071 | A | | 6/1983 | Johnson, Jr. et al. |
| 4,408,719 | A | | 10/1983 | Last |
| 4,428,802 | A | | 1/1984 | Kanai et al. |
| 4,431,136 | A | | 2/1984 | Janner et al. |
| 4,454,877 | A | | 6/1984 | Miller et al. |
| 4,465,234 | A | | 8/1984 | Maehara et al. |
| 4,474,251 | A | | 10/1984 | Johnson, Jr. |
| 4,474,326 | A | | 10/1984 | Takahashi |
| 4,475,113 | A | | 10/1984 | Lee et al. |
| 4,479,609 | A | | 10/1984 | Maeda et al. |
| 4,512,341 | A | | 4/1985 | Lester |
| 4,530,464 | A | | 7/1985 | Yamamoto et al. |
| 4,533,082 | A | | 8/1985 | Maehara et al. |
| 4,539,575 | A | | 9/1985 | Nilsson |
| 4,544,933 | A | | 10/1985 | Heinzl |
| 4,546,361 | A | | 10/1985 | Brescia et al. |
| 4,550,325 | A | | 10/1985 | Viola |
| 4,566,452 | A | | 1/1986 | Farr |
| 4,591,883 | A | | 5/1986 | Isayama |
| 4,593,291 | A | | 6/1986 | Howkins |
| 4,605,167 | A | * | 8/1986 | Maehara ..... 239/102.2 |
| 4,613,326 | A | | 9/1986 | Szwarc |
| 4,620,201 | A | | 10/1986 | Heinzl et al. |
| 4,628,890 | A | | 12/1986 | Freeman |
| 4,632,311 | A | | 12/1986 | Nakane et al. |
| 4,658,269 | A | | 4/1987 | Rezanka |
| 4,659,014 | A | | 4/1987 | Soth et al. |
| 4,677,975 | A | | 7/1987 | Edgar et al. |
| 4,678,680 | A | | 7/1987 | Abowitz |
| 4,679,551 | A | | 7/1987 | Anthony |
| 4,681,264 | A | | 7/1987 | Johnson, Jr. |
| 4,693,853 | A | | 9/1987 | Falb et al. |
| 4,702,418 | A | | 10/1987 | Carter et al. |
| 4,722,906 | A | | 2/1988 | Guire |
| 4,753,579 | A | | 6/1988 | Murphy |
| 4,790,479 | A | | 12/1988 | Matsumoto et al. |
| 4,793,339 | A | | 12/1988 | Matsumoto et al. |
| 4,796,807 | A | | 1/1989 | Bendig et al. |
| 4,799,622 | A | | 1/1989 | Ishikawa et al. |
| 4,805,609 | A | | 2/1989 | Roberts et al. |
| 4,819,629 | A | | 4/1989 | Jonson |
| 4,819,834 | A | | 4/1989 | Thiel |
| 4,826,080 | A | | 5/1989 | Ganser |
| 4,826,759 | A | | 5/1989 | Guire et al. |
| 4,828,886 | A | | 5/1989 | Hieber |
| 4,843,445 | A | | 6/1989 | Stemme |
| 4,849,303 | A | | 7/1989 | Graham et al. |
| 4,850,534 | A | | 7/1989 | Takahashi et al. |
| 4,865,006 | A | | 9/1989 | Nogi et al. |
| 4,871,489 | A | | 10/1989 | Ketcham |
| 4,872,553 | A | | 10/1989 | Suzuki et al. |
| 4,877,989 | A | | 10/1989 | Drews et al. |
| 4,888,516 | A | | 12/1989 | Daeges et al. |
| 4,922,901 | A | | 5/1990 | Brooks et al. |

4,926,915 A 5/1990 Deussen et al.
4,934,358 A 6/1990 Nilsson et al.
4,954,225 A 9/1990 Bakewell
4,957,239 A 9/1990 Tempelman
4,964,521 A 10/1990 Wieland et al.
D312,209 S 11/1990 Morrow et al.
4,968,299 A 11/1990 Ahlstrand et al.
4,971,665 A 11/1990 Sexton
4,973,493 A 11/1990 Guire
4,976,259 A 12/1990 Higson et al.
4,979,959 A 12/1990 Guire
4,994,043 A 2/1991 Ysebaert
5,002,048 A 3/1991 Makiej, Jr.
5,002,582 A 3/1991 Guire et al.
5,007,419 A 4/1991 Weinstein et al.
5,016,024 A 5/1991 Lam et al.
5,021,701 A 6/1991 Takahashi et al.
5,022,587 A 6/1991 Hochstein
5,024,733 A 6/1991 Abys et al.
5,046,627 A 9/1991 Hansen
5,062,419 A 11/1991 Rider
5,063,396 A 11/1991 Shiokawa et al.
5,063,922 A 11/1991 Häkkinen
5,073,484 A 12/1991 Swanson et al.
5,076,266 A 12/1991 Babaev
5,080,093 A 1/1992 Raabe et al.
5,080,649 A 1/1992 Vetter
5,086,765 A 2/1992 Levine
5,086,785 A 2/1992 Gentile et al.
5,115,803 A 5/1992 Sioutas
5,115,971 A 5/1992 Greenspan et al.
D327,008 S 6/1992 Friedman
5,122,116 A 6/1992 Kriesel et al.
5,129,579 A 7/1992 Conte
5,134,993 A 8/1992 Van Der Linden et al.
5,139,016 A 8/1992 Waser
5,140,740 A 8/1992 Weigelt
5,147,073 A 9/1992 Cater
5,152,456 A 10/1992 Ross et al.
5,157,372 A 10/1992 Langford
5,164,740 A 11/1992 Ivri
5,169,029 A 12/1992 Behar et al.
5,170,782 A 12/1992 Kocinski
5,180,482 A 1/1993 Abys et al.
5,186,164 A 2/1993 Raghuprasad
5,186,166 A 2/1993 Riggs et al.
5,198,157 A 3/1993 Bechet
5,201,322 A 4/1993 Henry et al.
5,213,860 A 5/1993 Laing
5,217,148 A 6/1993 Cater
5,217,492 A 6/1993 Guire et al.
5,227,168 A 7/1993 Chvapil
5,230,496 A 7/1993 Shillington et al.
5,245,995 A 9/1993 Sullivan et al.
5,248,087 A 9/1993 Dressler
5,258,041 A 11/1993 Guire et al.
5,261,601 A 11/1993 Ross et al.
5,263,992 A 11/1993 Guire
5,279,568 A 1/1994 Cater
5,297,734 A 3/1994 Toda
5,299,739 A 4/1994 Takahashi et al.
5,303,854 A 4/1994 Cater
5,309,135 A 5/1994 Langford
5,312,281 A 5/1994 Takahashi et al.
5,313,955 A 5/1994 Rodder
5,319,971 A 6/1994 Osswald et al.
5,320,603 A 6/1994 Vetter et al.
5,322,057 A 6/1994 Raabe et al.
5,342,011 A 8/1994 Short
5,342,504 A 8/1994 Hirano et al.
5,347,998 A 9/1994 Hodson et al.
5,348,189 A 9/1994 Cater
5,350,116 A 9/1994 Cater
5,355,872 A 10/1994 Riggs et al.
5,357,946 A 10/1994 Kee et al.
5,372,126 A 12/1994 Blau
5,383,906 A 1/1995 Burchett et al.
5,388,571 A 2/1995 Roberts et al.
5,392,768 A 2/1995 Johansson et al.
5,396,883 A 3/1995 Knupp et al.
5,414,075 A 5/1995 Swan et al.
5,415,161 A 5/1995 Ryder
5,419,315 A 5/1995 Rubsamen
5,426,458 A 6/1995 Wenzel et al.
5,431,155 A 7/1995 Marelli
5,435,282 A 7/1995 Haber et al.
5,435,297 A 7/1995 Klein
5,437,267 A 8/1995 Weinstein et al.
5,445,141 A 8/1995 Kee et al.
D362,390 S 9/1995 Weiler
5,449,502 A 9/1995 Igusa et al.
5,452,711 A 9/1995 Gault
5,458,135 A 10/1995 Patton et al.
5,458,289 A 10/1995 Cater
5,474,059 A 12/1995 Cooper
5,477,992 A 12/1995 Jinks et al.
5,479,920 A 1/1996 Piper et al.
5,487,378 A * 1/1996 Robertson et al. ..... 128/200.16
5,489,266 A 2/1996 Grimard
5,497,944 A 3/1996 Weston et al.
D369,212 S 4/1996 Snell
5,511,726 A 4/1996 Greenspan et al.
5,512,329 A 4/1996 Guire et al.
5,512,474 A 4/1996 Clapper et al.
5,515,841 A 5/1996 Robertson et al.
5,515,842 A 5/1996 Ramseyer et al.
5,516,043 A 5/1996 Manna et al.
5,518,179 A 5/1996 Humberstone et al.
5,529,055 A 6/1996 Gueret
5,533,497 A 7/1996 Ryder
5,542,410 A 8/1996 Goodman et al.
5,549,102 A 8/1996 Lintl et al.
5,560,837 A 10/1996 Trueba
5,563,056 A 10/1996 Swan et al.
D375,352 S 11/1996 Bologna
5,579,757 A 12/1996 McMahon et al.
5,582,330 A 12/1996 Iba
5,584,285 A 12/1996 Salter et al.
5,586,550 A 12/1996 Ivri et al.
5,588,166 A 12/1996 Burnett
5,601,077 A 2/1997 Imbert
5,609,798 A 3/1997 Liu et al.
5,632,878 A 5/1997 Kitano
5,635,096 A 6/1997 Singer et al.
5,637,460 A 6/1997 Swan et al.
5,647,349 A 7/1997 Ohki et al.
5,653,227 A 8/1997 Barnes et al.
5,654,007 A 8/1997 Johnson et al.
5,654,162 A 8/1997 Guire et al.
5,654,460 A 8/1997 Rong
5,657,926 A 8/1997 Toda
5,660,166 A 8/1997 Lloyd
5,664,557 A 9/1997 Makiej, Jr.
5,664,706 A 9/1997 Cater
5,665,068 A 9/1997 Takamura
5,666,946 A 9/1997 Langenback
5,670,999 A 9/1997 Takeuchi et al.
5,685,491 A 11/1997 Marks et al.
5,692,644 A 12/1997 Gueret
5,707,818 A 1/1998 Chudzik et al.
5,709,202 A 1/1998 Lloyd et al.
5,714,360 A 2/1998 Swan et al.
5,714,551 A 2/1998 Bezwada et al.
5,718,222 A 2/1998 Lloyd et al.
D392,184 S 3/1998 Weiler
5,724,957 A 3/1998 Rubsamen et al.

5,744,515 A 4/1998 Clapper
5,752,502 A 5/1998 King
5,755,218 A 5/1998 Johansson et al.
5,758,637 A 6/1998 Ivri et al.
5,775,506 A 7/1998 Grabenkort
5,788,665 A 8/1998 Sekins
5,788,819 A 8/1998 Onishi et al.
5,790,151 A 8/1998 Mills
5,810,004 A 9/1998 Ohki et al.
5,819,730 A 10/1998 Stone et al.
5,823,179 A 10/1998 Grychowski et al.
5,823,428 A 10/1998 Humberstone et al.
5,829,723 A 11/1998 Brunner et al.
5,836,515 A 11/1998 Fonzes
5,839,617 A 11/1998 Cater et al.
5,842,468 A 12/1998 Denyer et al.
5,862,802 A 1/1999 Bird
5,865,171 A 2/1999 Cinquin
5,878,900 A 3/1999 Hansen
5,893,515 A 4/1999 Hahn et al.
5,894,841 A 4/1999 Voges
5,897,008 A 4/1999 Hansen
5,910,698 A 6/1999 Yagi
5,915,377 A 6/1999 Coffee
5,918,637 A 7/1999 Fleischman
5,925,019 A 7/1999 Ljungquist
5,938,117 A 8/1999 Ivri
5,950,619 A 9/1999 Van Der Linden et al.
5,954,268 A 9/1999 Joshi et al.
5,960,792 A 10/1999 Lloyd et al.
5,964,417 A 10/1999 Amann et al.
5,970,974 A 10/1999 Van Der Linden et al.
5,976,344 A 11/1999 Abys et al.
5,993,805 A 11/1999 Sutton et al.
6,000,396 A 12/1999 Melker et al.
6,007,518 A 12/1999 Kriesel et al.
6,012,450 A 1/2000 Rubsamen
6,014,970 A 1/2000 Ivri et al.
6,026,809 A 2/2000 Abrams et al.
6,029,666 A 2/2000 Aloy et al.
6,032,665 A 3/2000 Psaros
6,037,587 A 3/2000 Dowell et al.
6,045,215 A 4/2000 Coulman
6,045,874 A 4/2000 Himes
6,047,818 A 4/2000 Warby et al.
6,055,869 A 5/2000 Stemme et al.
6,060,128 A 5/2000 Kim et al.
6,062,212 A 5/2000 Davison et al.
6,068,148 A 5/2000 Weiler
6,085,740 A 7/2000 Ivri et al.
6,096,011 A 8/2000 Trombley, III et al.
6,105,877 A 8/2000 Coffee
6,106,504 A 8/2000 Urrutia
6,116,234 A 9/2000 Genova et al.
6,123,413 A 9/2000 Agarwal et al.
6,139,674 A 10/2000 Markham et al.
6,142,146 A 11/2000 Abrams et al.
6,145,963 A 11/2000 Pidwerbecki et al.
6,146,915 A 11/2000 Pidwerbecki et al.
6,152,130 A 11/2000 Abrams et al.
6,155,676 A 12/2000 Etheridge et al.
6,158,431 A 12/2000 Poole
6,161,536 A 12/2000 Redmon et al.
6,163,588 A 12/2000 Matsumoto et al.
6,182,662 B1 2/2001 McGhee
6,186,141 B1 2/2001 Pike et al.
6,196,218 B1 3/2001 Voges
6,196,219 B1 3/2001 Hess et al.
6,205,999 B1 3/2001 Ivri et al.
6,216,916 B1 4/2001 Maddox et al.
6,223,746 B1 5/2001 Jewett et al.
6,235,177 B1 5/2001 Borland et al.
6,254,219 B1 7/2001 Agarwal et al.
6,269,810 B1 8/2001 Brooker et al.
6,270,473 B1 8/2001 Schwebel
6,273,342 B1 8/2001 Terada et al.
6,318,640 B1 11/2001 Coffee
6,328,030 B1 12/2001 Kidwell et al.
6,328,033 B1 12/2001 Avrahami
6,341,732 B1 1/2002 Martin et al.
6,358,058 B1 3/2002 Strupat et al.
6,394,363 B1 5/2002 Arnott et al.
6,402,046 B1 6/2002 Loser
6,405,934 B1 6/2002 Hess et al.
6,427,682 B1 8/2002 Klimowicz et al.
6,443,146 B1 9/2002 Voges
6,443,366 B1 9/2002 Hirota et al.
6,467,476 B1 10/2002 Ivri et al.
6,530,370 B1 3/2003 Heinonen
6,540,153 B1 4/2003 Ivri
6,540,154 B1 4/2003 Ivri et al.
6,543,443 B1 4/2003 Klimowicz et al.
6,546,927 B2 4/2003 Litherland et al.
6,550,472 B2 4/2003 Litherland et al.
6,554,201 B2 4/2003 Klimowicz et al.
6,581,595 B1 6/2003 Murdock et al.
6,612,303 B1 * 9/2003 Grychowski et al. ..... 239/338
6,615,824 B2 9/2003 Power
6,629,646 B1 10/2003 Ivri
6,640,804 B2 11/2003 Ivri et al.
6,651,650 B1 11/2003 Yamamoto et al.
6,732,944 B2 5/2004 Litherland et al.
6,755,189 B2 6/2004 Ivri et al.
6,769,626 B1 8/2004 Haveri
6,782,886 B2 8/2004 Narayan et al.
6,814,071 B2 11/2004 Klimowicz et al.
6,845,770 B2 1/2005 Klimowicz et al.
6,851,626 B2 2/2005 Patel et al.
6,860,268 B2 3/2005 Bohn et al.
7,040,549 B2 5/2006 Ivri et al.
7,108,197 B2 * 9/2006 Ivri ..... 239/102.2
2001/0013554 A1 8/2001 Borland et al.
2001/0015737 A1 8/2001 Truninger et al.
2002/0011247 A1 1/2002 Ivri et al.
2002/0078958 A1 6/2002 Stenzler
2002/0104530 A1 8/2002 Ivri et al.
2002/0121274 A1 9/2002 Borland et al.
2002/0134372 A1 9/2002 Loeffler et al.
2002/0134374 A1 9/2002 Loeffler et al.
2002/0134375 A1 9/2002 Loeffler et al.
2002/0134377 A1 9/2002 Loeffler et al.
2002/0162551 A1 11/2002 Litherland
2003/0140921 A1 7/2003 Smith et al.
2003/0150445 A1 8/2003 Power et al.
2003/0150446 A1 8/2003 Patel et al.
2003/0226906 A1 12/2003 Ivri
2004/0000598 A1 1/2004 Ivri
2004/0004133 A1 1/2004 Ivri et al.
2004/0035413 A1 2/2004 Smaldone et al.
2004/0035490 A1 2/2004 Power
2004/0050947 A1 3/2004 Power et al.
2004/0139963 A1 7/2004 Ivri et al.
2004/0139968 A1 7/2004 Loeffler et al.
2004/0188534 A1 9/2004 Litherland et al.
2004/0256488 A1 12/2004 Loeffler et al.
2005/0011514 A1 1/2005 Power et al.

FOREIGN PATENT DOCUMENTS

CH 477 855 A 9/1969
CH 555 681 11/1974
DE 11 03 522 3/1961
EP 0 049 636 A1 4/1982
EP 0 103 161 A2 3/1984
EP 0 134 847 A1 3/1985
EP 0 178 925 A2 4/1986

| | | | |
|---|---|---|---|
| EP | 0 387 222 | A1 | 9/1990 |
| EP | 0 432 992 | A1 | 6/1991 |
| EP | 0 476 991 | | 3/1992 |
| EP | 0 480 615 | A1 | 4/1992 |
| EP | 0 510 648 | A2 | 10/1992 |
| EP | 0 516 565 | A1 | 12/1992 |
| EP | 0 542 723 | A2 | 5/1993 |
| EP | 0 682 570 | A1 | 11/1995 |
| EP | 0 933 138 | A | 4/1999 |
| EP | 0 923 957 | | 6/1999 |
| EP | 1 142 600 | | 10/2001 |
| FR | 2 692 569 | | 12/1993 |
| GB | 973 458 | | 10/1964 |
| GB | 1 454 597 | | 11/1976 |
| GB | 2 073 616 | A | 10/1981 |
| GB | 2 101 500 | | 1/1983 |
| GB | 2 177 623 | A | 1/1987 |
| GB | 2 240 494 | A | 7/1991 |
| GB | 2 272 389 | A | 5/1994 |
| GB | 2 279 571 | A | 1/1995 |
| JP | 57-023852 | | 2/1982 |
| JP | 57-105608 | | 7/1982 |
| JP | 58-061857 | | 4/1983 |
| JP | 58-139757 | | 8/1983 |
| JP | 59-142163 | A | 8/1984 |
| JP | 60-004714 | | 1/1985 |
| JP | 61-008357 | A | 1/1986 |
| JP | 61-215059 | A | 9/1986 |
| JP | 02-135169 | | 5/1990 |
| JP | 02-189161 | | 7/1990 |
| JP | 60-07721 | | 1/1994 |
| WO | WO 82/03548 | A | 10/1982 |
| WO | WO 92/07600 | | 5/1992 |
| WO | WO 92/11050 | | 9/1992 |
| WO | WO 92/17231 | | 10/1992 |
| WO | WO 93/01404 | A1 | 1/1993 |
| WO | WO 93/10910 | A1 | 6/1993 |
| WO | WO 94/09912 | A1 | 5/1994 |
| WO | WO 96/09229 | | 3/1996 |
| WO | WO 96/31289 | A1 | 10/1996 |
| WO | WO 97/07896 | | 3/1997 |
| WO | WO 99/17888 | | 4/1999 |
| WO | WO 99/63946 | | 12/1999 |
| WO | WO 00/37132 | | 6/2000 |
| WO | WO 01/18280 | A1 | 3/2001 |
| WO | WO 01/51110 | A1 | 7/2001 |
| WO | WO 02/04055 | A1 | 1/2002 |
| WO | WO 02/28539 | A1 | 4/2002 |
| WO | WO 02/36181 | A2 | 5/2002 |
| WO | WO 02/074360 | A2 | 9/2002 |
| WO | WO 02/074373 | A1 | 9/2002 |
| WO | WO 02/074374 | A1 | 9/2002 |
| WO | WO 02/074443 | A2 | 9/2002 |
| WO | WO 02/078424 | A1 | 10/2002 |
| WO | WO 02/087772 | A1 | 11/2002 |
| WO | WO 02/087773 | A1 | 11/2002 |
| WO | WO 02/087774 | A1 | 11/2002 |
| WO | WO 03/028895 | A2 | 4/2003 |
| WO | WO 2005/009323 | | 2/2005 |

OTHER PUBLICATIONS

Allen, T. *Particle Size Measurement*, Third Edition, Chapman and Hall, pp. 167-169 (1981).

Andersin, M. et al., "Subspace Based Estimation of the Signal to Interference Ratio for TDMA Cellular Systems," Proceedings of the Vehicular Technology Conference (VTC), pp. 1155-1159, May 1996.

Ashgriz, N. et al. "Development of a Controlled Spray Generator" Rev. Sci. Instrum., 1987, pp. 1291-1296, vol. 58, No. 7.

Austin, M.D. and Stuber, G.L. "In-Service Signal Quality Estimation for TDMA Cellular Systems," Proceedings of the Personal Indoor Mobile Radio Conference (PIMRC), pp. 836-840, Sep. 1995.

Berggren, E. "Pilot Study of Nebulized Surfactant Therapy for Neonatal Respiratory Distress Syndrome", Acta Paediatr 89: 460-464, Taylor & Francis, ISSN 0803-5253, 2000, Sweden.

Berglund, R.N., et al. "Generation of Monodisperse Aerosol Standards" Environ. Sci. Technology, Feb. 1973, pp. 147-153, vol. 7, No. 2.

Cipolla, D.C. et al., "Assessment of Aerosol Delivery Systems for Recombinant Human Deoxyribonuclease," S.T.P. Pharma Sciences 4 (1) 50-62, 1994.

Cipolla, D.C. et al., "Characterization of Aerosols of Human Recombinant Deoxyribonuclease I (rhDNase) Generated by Neulizers," Pharmaceutical Research II (4) 491-498, 1994.

Dogan, Aydin PhD, Thesis: "Flexional 'Moonie and Cymbal' Actuators", Penn State University, 1994.

Duarte, Alexander G. et al. "Inhalation Therapy During Mechanical Ventialation" Respiratory Care Clinics of North America, Aerosol Therapy, Jun. 2001, pp. 233-259, vol. 7, No. 2.

Fink, James B. et al. "Aerosol Therapy in Mechanically Ventilated Patients: Recent Advances and New Techniques" Seminars in Respiratory and Critical Care Medicine, 2000, pp. 183-201, vol. 21, No. 3.

Fink, James B. et al. Diagram from and abstract of article entitled "Optimizing efficiency of nebulizers during mechanical ventilation: The effect of placement and type of ventilator circuit" Chest, Oct. 1999, 116:312S.

Fink, James B., "Aerosol Drug Therapy," Clinical Practice in Respiratory Care; Chapter 12, pp. 308-342; 1999.

Furuskar et al., "EDGE: Enhanced Data Rates for GSM and TDMA/136 Evolution," IEEE Personal Communications Magazine, pp. 56-66, Jun. 1999.

Gaiser Tool Company catalog, pp. 26, 29-30 (1990).

Gilchriest, C.E. "Signal-to-Noise Monitoring," JPL Space Programs Summary, vol. IV, No. 32-37, pp. 169-184, Jun. 1966.

Gonda, I. "Therapeutic Aerosols," Pharmaceutics, The Science of Dosage Form Design, Editor: M.E. Aulton, 341-358, 1988.

Hancock, B.C. et al., "Molecular Mobility of Amorphous Pharmaceutical Solids Below Their Glass Transition Temperatures," Pharmaceutical Research 12, 799-806 (1995).

Heyder, J. et al., "Deposition of particles in the human respiratory tract in the size range 0.005-15 microns." J Aerosol Sci 17: 811-825, 1986.

Hickey, Anthony J. "Pharmaceutical Inhalation Aerosol Technology," Drugs And The Pharmaceutical Science, 1992, pp. 172-173, vol. 54.

Higuchi, K. et al. "Experimental Evaluation of Combined Effect of Coherent Rake Combining and SIR-Based Fast Transmit Power Control for Reverse Link of DS-CDMA Mobile Radio," IEEE Journal on Selected Areas in Comm., vol. 18, No. 8, pp. 1526-1535. (No. date).

Hikayama, H., et al. "Ultrasonic Atomizer with Pump Function" Tech. Rpt. IEICE Japan US88-74:25 (1988).

Jorch, G. Letter to the Editor, "Surfactant Aerosol Treatment of Respiratory Distress Syndrome in Spontaneously Breathing Premature Infants", Pediatric Pulmonology 24: 222-224, 1997, Wiley-Liss, Inc.

Jorissen, A.L., "Discharged Measurement at Low Reynolds Number", ASME, Feb. 1956, pp. 365-368.

Layland, J.W. "On S/N Estimation," JPL Space Programs Summary, vol. III, No. 37-48, pp. 209-212, 1967.

Maehara, N. et al. "Atomizing rate control of a multi-pinhole-plate ultrasonic atomizer" J. Acoustical Soc. Japan, 1988, pp. 116-121, 44:2.

Maehara, N. et al. "Influence of the vibrating system of a multipinhole-plate ultrasonic nebulizer on its performance" Review of Scientific Instruments, Nov. 1986, p. 2870-2876, vol. 57, No. 1.

Maehara, N. et al. "Influences of liquid's physical properties on the characteristics of a multi-pinhole-plate ultrasonic atomizer" J. Acoustical Soc. Japan 1988, pp. 425-431, 44:6.

Maehara, N. et al. "Optimum Design Procedure for Multi-Pinhole-Plate Ultrasonic Atomizer " Japanese Journal of Applied Physics, 1987, pp. 215-217, vol. 26, Supplement 26-1.

Manning, M.C. et al., "Stability of Protein Pharmaceuticals," Pharmaceutical Research 6, 903-918 (1989).

Nogi, T. et al. "Mixture Formation of Fuel Injection System in Gasoline Engine" Nippon Kikai Gakkai Zenkoku Taikai Koenkai Koen Ronbunshu 69:660-662(1991).
Palla Tech Pd an Pd Alloy Processes—Procedure for the Analysis of Additive IVS in Palla Tech Plating Solutions by HPLC, Technical Bulletin, Electroplating Chemicals & Services, 029-A, Lucent Technologies,, pp. 1-5, 1996.
Pauluzzi, D.R. and N.C. Beaulieu, "A Comparison of SNR Estimation Techniques in the AWGN Channel," Proceedings of IEEE Pacific Rim Conference on Communications, Computers and Signal Processing, pp. 36-39, 1995.
Rukhin, A.L. "Estimating the Noncentrality Parameter of A t-Distribution," Systems Science and Mathematical Sciences, vol. 5, No. 1, pp. 1-8, 1992.
Satterthwaite, F.E. "An Approximate Distribution of Estimates of Variance Components," Biometrika Bulletin, vol. 2, pp. 110-114, 1946.
Siemens, "Servo Ultra Nebulizer 345 Operating Manual," pp. 1-23.
Smaldone, G. C. "Aerosolized Antibiotics: Current and Future", Respiratory Care, vol. 45, No. 6, pp. 667-675.
Smedsaas-Löfvenbert, A. "Nebulization of Drugs in a Nasal CPAP System", Scandinavian University Press, 1999, Acta Paediatr 88: 89-92, Sweden.
Tiku, M.L. "Doubly Noncentral F-Distributions—Tables and Applications," Selected Tables in Mathematical Statistics, vol. 2, pp. 139-149. (No. date).
TSI Incorporated product catalog. Vibrating Orifice Aerosol Generator (1989).
Uchino, Kenji *Piezoelectric Actuators and Ultrasonic Motors*, Nov. 1996.
Ueha, S., et al. "Mechanism of Ultrasonic Atomization Using a Multi-Pinhole Plate" J. Acoust. Soc. Jpn., 1985, pp. 21-26, (E)6,1.
Wehl, Wolfgang R. "Ink-Jet Printing: The Present State of the Art" for Siemens AG, 1989.

* cited by examiner

SYSTEMS AND METHODS FOR CONTROLLING FLUID FEED TO AN AEROSOL GENERATOR

CROSS-REFERENCES TO RELATED APPLICATIONS

This application is a continuation application of U.S. patent application Ser. No. 10/394,512, filed Mar. 21, 2003, which is a continuation-in-part application of U.S. patent application Ser. No. 09/318,552, filed May 27, 1999, which is a continuation application of U.S. patent application Ser. No. 08/417,311, filed Apr. 5, 1995 (now U.S. Pat. No. 5,938,117), which is a continuation-in-part application of U.S. patent application Ser. No. 08/163,850 filed on Dec. 7, 1993, which is a continuation-in-part of U.S. patent application Ser. No. 07/726,777 filed on Jul. 8, 1991 (now abandoned), which is a continuation-in-part of U.S. patent application Ser. No. 07/691,584 filed on Apr. 24, 1991, now U.S. Pat. No. 5,164,740. The complete disclosures of all these references are herein incorporated by reference.

BACKGROUND OF THE INVENTION

The present invention relates to improved aerosolizing devices, particularly but not exclusively for atomizing liquid medicaments to be inhaled, and to a method of constructing such devices.

A wide variety of procedures have been proposed to deliver a drug to a patient. Of particular interest to the present invention are drug delivery procedures where the drug is a liquid and is dispensed in the form of fine liquid droplets for inhalation by a patient. A variety of devices have been proposed for forming the dispersion, including air jet nebulizers, ultrasonic nebulizers and metered dose inhalers (MDIs). Air jet nebulizers usually utilize a high pressure air compressor and a baffle system that separates the large particles from the spray. Ultrasonic nebulizers generate ultrasonic waves with an oscillating piezoelectric crystal to produce liquid droplets. Another type of ultrasonic nebulizer is described in U.S. Pat. Nos. 5,261,601 and 4,533,082. Typical MDIs usually employ a gas propellant, such as a CFC, which carries the therapeutic substance and is sprayed into the mouth of the patient.

The present applicant has also proposed a variety of aerosolization devices for atomizing liquid solutions. For example, one exemplary atomization apparatus is described in U.S. Pat. No. 5,164,740, the complete disclosure of which is herein incorporated by reference. The atomization apparatus comprises an ultrasonic transducer and an aperture plate attached to the transducer. The aperture plate includes tapered apertures which are employed to produce small liquid droplets. The transducer vibrates the plate at relatively high frequencies so that when the liquid is placed in contact with the rear surface of the aperture plate and the plate is vibrated, liquid droplets will be ejected through the apertures. The apparatus described in U.S. Pat. No. 5,164,740 has been instrumental in producing small liquid droplets without the need for placing a fluidic chamber in contact with the aperture plate. Instead, small volumes of liquid are delivered to the rear surface of the aperture plate and held in place by surface tension forces.

Modified atomization apparatus are described in U.S. Pat. Nos. 5,586,550 and 5,758,637, the complete disclosures of which are herein incorporated by reference. The two references describe a liquid droplet generator which is particularly useful in producing a high flow of droplets in a narrow size distribution. As described in U.S. Pat. No. 5,586,550, the use of a dome shaped aperture plate is advantageous in allowing more of the apertures to eject liquid droplets.

One requirement of such aerosolization devices is the need to supply liquid to the aperture plate. In some applications, such as when delivering aerosolized medicaments to the lungs, it may be desirable to regulate the supply of the liquid to the aperture plate so that proper pulmonary delivery of the drug may occur. For example, if too much liquid is supplied, the aerosol generator may be unable to aerosolize fully all of the delivered liquid. On the other hand, if too little liquid is supplied, the user may not receive a sufficient dosage. Further, a metering process may be needed to ensure that a unit dosage amount of the liquid is delivered to the aerosol generator. This may be challenging if the user requires several inhalations in order to inhale the unit dose amount.

The present invention is related to liquid feed systems and methods for delivering liquids to the aerosol generator to facilitate aerosolization of the liquid.

BRIEF SUMMARY OF THE INVENTION

The invention provides exemplary aerosolization devices and methods for aerosolizing liquids. In one embodiment, an aerosolization device comprises a liquid supply system that is adapted to hold a supply of liquid, and an aerosol generator that is configured to aerosolize liquid supplied from the liquid supply system. In one aspect, the aerosol generator may comprise a plate having a plurality of apertures and a vibratable element disposed to vibrate the plate. The aerosolization device further comprises a sensor configured to sense an amount of unaerosolized liquid supplied to the aerosol generator, and a controller to control operation of the liquid supply system based on information received from the sensor. In this way, during aerosolization the amount of unaerosolized liquid supplied to the aerosol generator remains within a certain range. In this manner, the device is configured to prevent either too much or too little liquid from being supplied to the aerosol generator at any one time.

In one aspect, the sensor comprises a strain gauge coupled to the aerosol generator for detecting variations in strain caused by varying amounts of unaerosolized liquid adhering to the aerosol generator. The strain gauge may comprise a piezoelectric element coupled to the aerosol generator such that variations in an electrical characteristic (e.g. impedance) are representative of unaerosolized liquid adhering to the aerosol generator. The piezoelectric element may also act as a transducer disposed to vibrate an aperture plate in the aerosol generator.

In another aspect, the sensor may comprise an optical sensor. The optical sensor may be configured to sense the presence or absence of unaerosolized liquid at a certain location on the aerosol generator. The certain location may be spaced from where liquid is supplied to the aerosol generator.

In yet another aspect, the sensor may be a conductivity sensor that is configured to sense electrical conductivity between at least two points across a surface of the aerosol generator on which unaerosolized liquid may adhere. At least one of the points may be spaced from where liquid is supplied to the aerosol generator. Further, at least one of the points may be closer to where liquid is supplied to the aerosol generator than another one of the points. In this way, sensing electrical conductivity may give an indication of unaerosolized liquid distribution across the aerosol generator.

In one particular embodiment, the amount of unaerosolized liquid on the aerosol generator remains within the range from about 0 to about 20 microliters, and more preferably from about 2 microliters to about 20 microliters.

The device may further comprise a housing having a mouthpiece, with the aerosol generator disposed in the housing for delivery of aerosolized liquid through the mouthpiece. In this way, a drug may be aerosolized and ready for pulmonary delivery upon patient inhalation.

In another particular aspect, the liquid supply system may comprise a dispenser for dispensing a certain amount of liquid upon receipt of an appropriate signal from the controller. In this way, a predetermined amount of liquid may be chosen to ensure the aerosol generator is not overloaded at any one time. The device may further comprise a meter for limiting the number of times the dispenser is activated during operation of the aerosol generator. In this way, the total liquid delivered by the aerosol generator in any one period of operation may be accurately controlled, thereby limiting the risk of delivering below or above a recommended dose.

In yet another particular embodiment, the device may further comprise a heater for heating unaerosolized liquid supplied to the aerosol generator. The heater may be adapted to heat the aerosol generator to vaporize or burn off residual unaerosolized liquid after aerosol generator cessation. In this way, residual unaerosolized liquid may be removed to prevent interference with a subsequent aerosolization event. The heater may comprise an electrical resistance heater and an electrical power supply (e.g. battery) for energizing resistance heating.

In another embodiment of the invention, a method for aerosolizing a liquid utilizes an aerosol generator that is operable to aerosolize a liquid. According to the method, a liquid is supplied to the aerosol generator from a liquid supply system at an initial flow rate. During aerosolization, the amount of supplied liquid remaining unaerosolized is sensed and the rate of liquid supply regulated based upon the sensed amount. The rate of liquid supply may be decreased if the sensed amount exceeds a certain value, and the rate of liquid supply may be increased if the sensed amount falls below a critical level. In this way, it is possible to prevent or to reduce the extent of supplying too much or too little liquid being supplied to the aerosol generator at any one time.

In one aspect, the method further comprises providing a heater for heating unaerosolized liquid supplied to the aerosol generator. By sensing whether any of the supplied liquid remains unaerosolized after cessation of the liquid supply, the heater may be operated to vaporize or burn-off such supplied liquid remaining on the aerosol generator.

In yet another embodiment of the invention, an aerosolization device comprises a liquid supply system that is adapted to hold a supply of liquid, and an aerosol generator comprising a plate having a plurality of apertures and an electric transducer disposed to vibrate the plate when energized. A sensor is configured to sense an electrical characteristic of the electrical transducer that is dependent upon an amount of unaerosolized liquid adhering to the plate. A controller is provided to regulate operation of the liquid supply in order to maintain the amount of unaerosolized liquid adhering to the plate within a certain range during aerosolization.

In a still further embodiment, a method is provided for controlling the supply of a liquid to an aerosol generator. According to the method, a liquid supply system is operated to supply a liquid to a vibratable aperture plate of an aerosol generator. An amount of liquid adhering to the vibratable plate is sensed and is used to control the amount of liquid supplied to the plate. By controlling operation of the liquid supply system, the amount of liquid adhering to the vibratable aperture plate may be regulated.

DETAILED DESCRIPTION OF THE INVENTION

Figure 1:
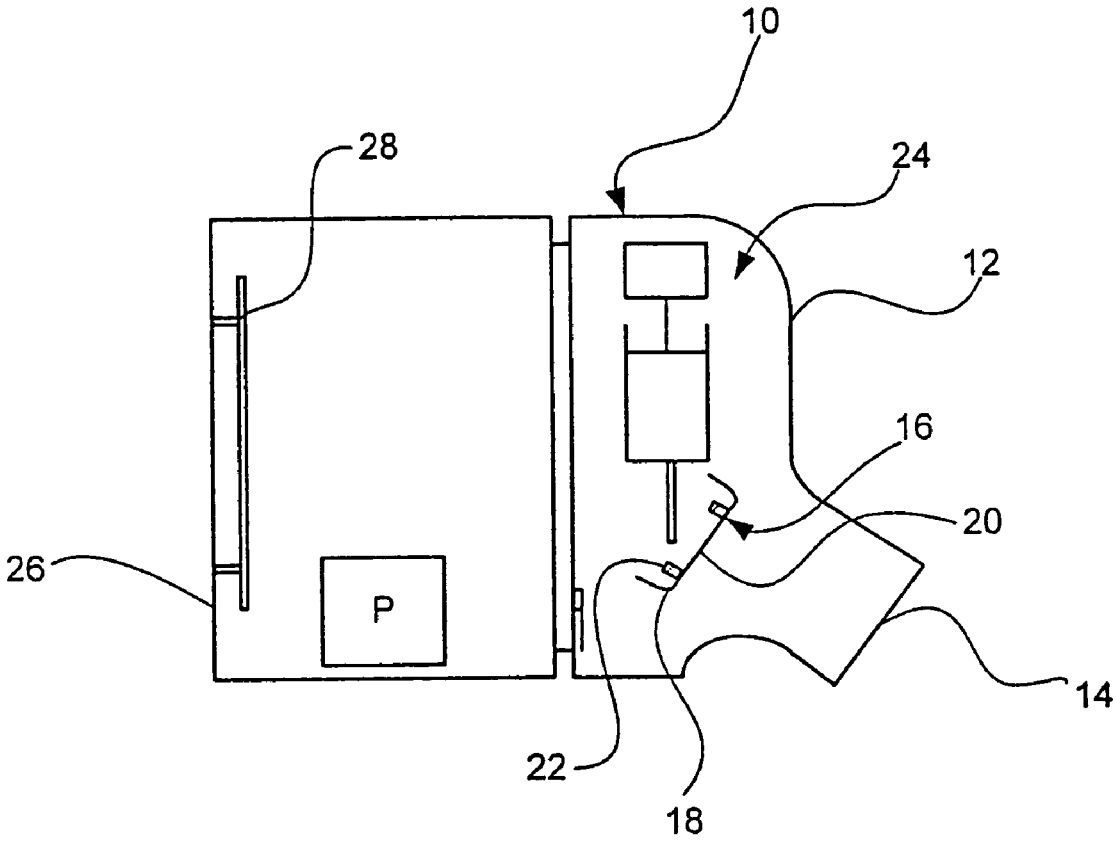
FIG. 1 is a cross-sectional schematic diagram of an aerosolization device according to the invention.

The invention provides exemplary aerosolization devices and methods for controlling the supply of a liquid to an aerosol generator. The invention is applicable to essentially any aerosolizer where liquid delivered to the aerosolizer may accumulate leading to variation in device performance. Merely by way of example, the invention may be used with atomizers such as those described in U.S. Pat. Nos. 5,140,740, 5,938,117, 5,586,550, and 6,014,970, incorporated herein by reference. However, it will be appreciated that the invention is not intended to be limited only to these specific atomizers.

The aerosolization device of the present invention may employ an aerosol generator such as described in U.S. patent application Ser. No. 09/318,552, now U.S. Pat. No. 6,540,153, previously incorporated herein by reference. The aerosol generator includes a free oscillating surface having microscopic tapered apertures of a selected conical cross-sectional shape. A layer of fluid adheres in surface tension contact with the oscillating surface. The apertures draw fluid into their large openings and eject the fluid from their small openings to a great distance. The ejection action is developed by the aperture, regardless of the amount of fluid in contact with the oscillating surface, and without any fluid pressure. Both sides of the oscillating surface are operating under the same ambient pressure. Therefore, the ejection device can operate equally well in vacuum or high-pressure environments. The supplied liquid continuously adheres to the large opening by surface tension. The film of fluid oscillates with the surface while it is being drawn into the large opening of the aperture and ejected forwardly. This continues until all the fluid is drawn from the surface, leaving the surface dry and free of liquid during the time that the device is not in use.

Aerosolization devices embodying the present invention conveniently sense the amount of unaerosolized liquid which has accumulated at the aerosol generator. This information is used to modify the rate of supply of liquid to the aerosol generator to maintain the amount of liquid adhering to the aerosol generator within certain limits. In this way, the aerosol generator is neither oversupplied nor under supplied with liquid, and is able to operate efficiently and effectively.

The sensor may take a variety of forms. For example, the sensor may be a piezoelectric device for sensing strains induced on the aerosol generator by liquid loads. Alternatively, the sensor may be an optical sensor, a conductivity sensor, or the like for sensing amounts of unaerosolized liquid on the aerosol generator. Another feature is the potential ability to vaporize or burn off unwanted unaerosolized liquid from the aerosol generator. The requisite heat may be applied by an electrical resistance heater, or the like.

In one embodiment, the supply of liquid to the aerosol generator is delivered in predetermined quantities. Each predetermined quantity may be a fraction of a total dose, and thus each delivery of the predetermined delivery may be counted. When the number of deliveries matches the quantity of the total dose, the liquid supply is interrupted.

Referring now to FIG. 1, one embodiment of an aerosolization device 10 will be described. Device 10 comprises a housing 12 to hold the various components of aerosolization device 10. Housing 12 further includes a mouthpiece 14 and one or more vents (not shown) to permit air to enter into housing 12 when a user inhales from mouthpiece 14. Disposed within housing 12 is an aerosol generator 16 that comprises a cup-shaped member 18 to which is coupled an aperture plate 20. An annular piezoelectric element 22 is in contact with aperture plate 20 to cause aperture plate 20 to vibrate when electrical current is supplied to piezoelectric element 22. Aperture plate 20 is dome-shaped in geometry and includes a plurality of tapered apertures that narrow from the rear surface to the front surface. Exemplary aperture plates and aerosol generators that may be used in aerosolization device 10 are described in U.S. Pat. Nos. 5,086,785, 5,157,372 and 5,309,135, incorporated herein by reference.

Aerosolization device 10 further includes a liquid feed system 24 having a supply of liquid that is to be aerosolized by aerosol generator 16. Liquid feed system 24 may be configured to place metered amounts of liquid onto aperture plate 20. Although not shown, a button or the like may be employed to dispense the liquid when requested by the user. Conveniently, feed system 24 may be configured to supply a unit dose of liquid over time to aperture plate 20. As described hereinafter, a variety of sensors may be used to monitor and control the amount of liquid supplied to aperture plate 20 so that the amount of unaerosolized liquid remains within a certain range.

Housing 12 includes an electronics region 26 for holding the various electrical components of aerosolization device 10. For example, region 26 may include a printed circuit board 28 which serves as a controller to control operation of the aerosol generator 16. More specifically, circuit board 28 may send (via circuitry not shown) an electrical signal to piezoelectric element 22 to cause aperture plate 20 to be vibrated. A power supply P, such as one or more batteries, is electrically coupled to circuit board 28 to provide aerosolization device 10 with power. Optionally, a flow sensor may be used to sense patient inhalation and to operate aerosol generator 16 only when a threshold flow rate has been produced by the user. One example of such a flow sensor is described in copending U.S. patent application Ser. No. 09/149,246, filed Sep. 8, 1998, the complete disclosure of which is herein incorporated by reference.

Figure 2:
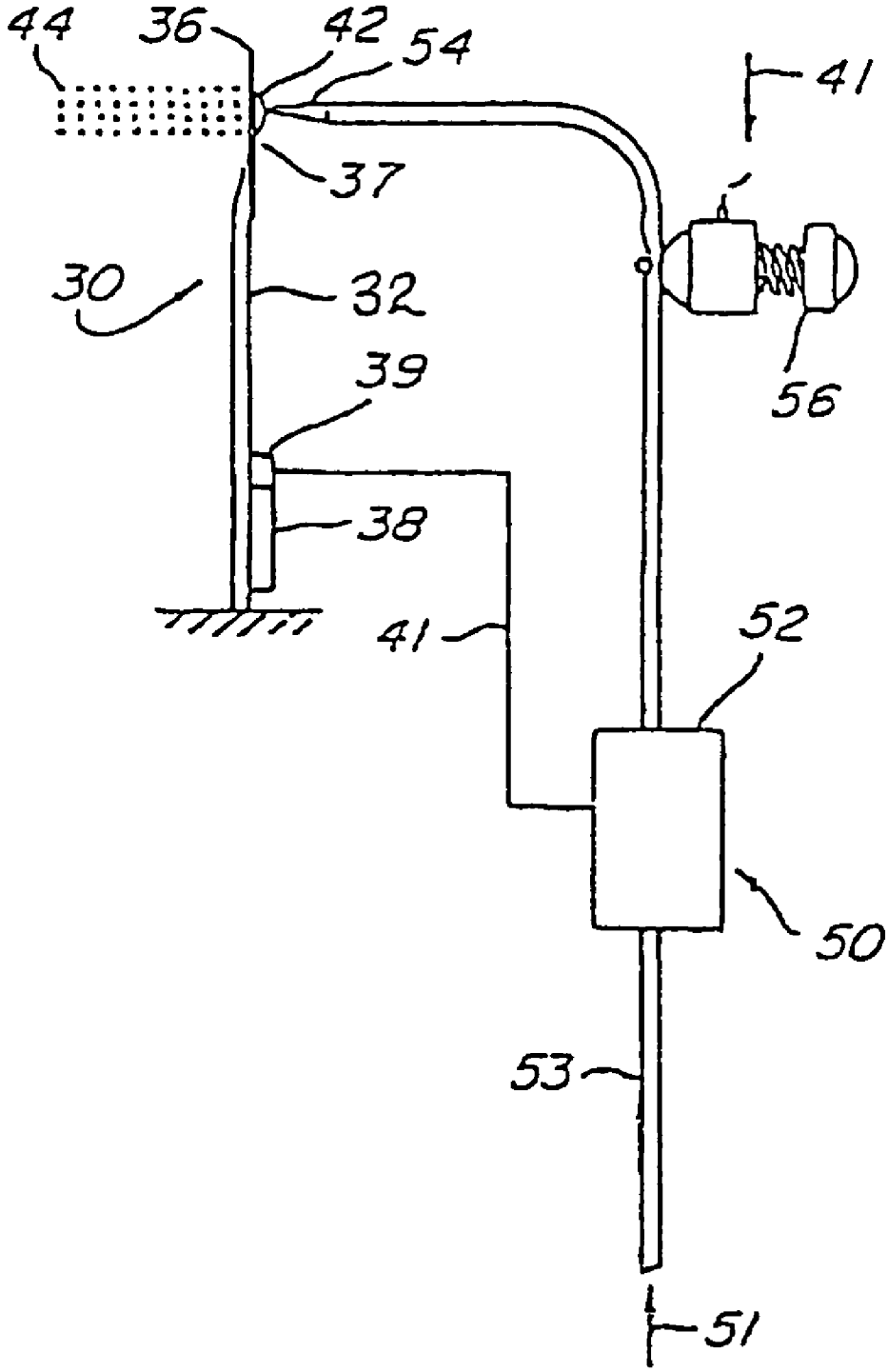
FIG. 2 is a schematic diagram showing an alternative aerosolization device and liquid supply system embodying the present invention.

FIG. 2 illustrates schematically an alternative aerosol generator 30 with one fluid supply system according to an embodiment of the invention. The fluid supply system is configured to maintain a proper supply of liquid to aerosol generator 30. Although described in connection with aerosol generator 30, it will be appreciated that the system of FIG. 2 may be used with any of the aerosolization devices described herein.

The aerosol generator 30 is in the form of a cantilevered beam 32 on which a piezoelectric oscillator 38 is mounted. The free end 37 of the beam 32 is provided with a planar surface through which there are microscopic tapered apertures. Fluid 42 in contact with the free end 37 is ejected through the tapered apertures producing droplets 44 when the beam is oscillated at high frequency by the piezoelectric oscillator 38. The fluid supply system 50 continuously transports fluid 51 to wet the oscillating surface 37 via a supply tube 53 ending at a supply nozzle 54. The fluid 51 is transported to the surface 37 at a rate which is lower than the maximum ejection rate of the apertures 40 to prevent overflow of fluid 42 from the supply side of the oscillating surface 37. A pinch valve 56 controls delivery of the fluid 51 to the oscillating surface 37. The fluid supply system 50 is connected to an electronic flow control valve 52 which is connected to an electronic circuit that detects the amount of liquid 42 on the oscillating surface 37. In the event of excessive delivery of fluid, the oscillation amplitude decreases and the current draw by the piezoelectric element 38 decreases. This is because as the load changes, there is a corresponding change in the impedance of the piezoelectric element. A current sensor circuit 39 senses the current draw and transmits an overflow signal 41 to the flow control valve 52 to reduce the delivery rate of the liquid 51 to the surface 37 until the amount of fluid returns to normal level.

The arrangement described in FIG. 2 utilizes an electrical characteristic (e.g. impedance) of the piezoelectric element 38 which is dependent upon the liquid load on aerosol generator 30. By sensing the electrical characteristic, either in absolute or relative terms, it is possible to control the rate of liquid supply to the aerosol generator in order to maintain the amount of unaerosolized liquid adhering to the beam 32 within certain limits. In other words, if the amount of unaerosolized liquid on the beam 32 falls below a lower limit, the flow rate may be increased to prevent the aerosol generator from running dry. On the other hand, if the amount of unaerosolized liquid on the beam 32 rises above an upper limit, the flow rate may be decreased or even temporarily suspended to prevent overloading of the aerosol generator. As previously mentioned, such a system may also be used with aerosol generator 16 of FIG. 1 by sensing the amount drawn by piezoelectric element 22.

Figure 3:
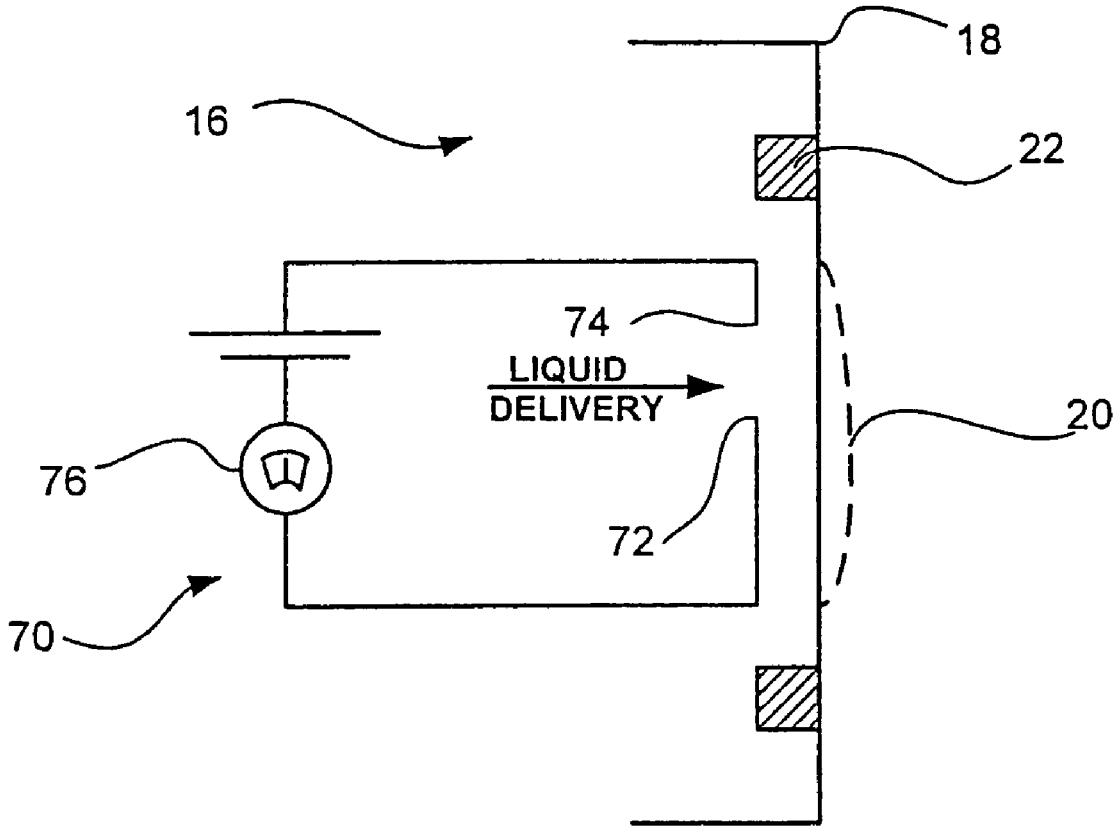
FIG. 3 is a schematic diagram of one embodiment of a fluid sensor according to the invention.

FIG. 3 schematically illustrates a conductive sensor 70 that may be used to sense the volume of fluid on an aperture plate, including any of those described herein. For convenience of discussion, sensor 70 is described with reference to aerosol generator 18 of FIG. 1. Conductive sensor 70 is used to measure electrical conductivity between two points 72,74 above a surface of aperture plate 20 to which unaerosolized liquid adheres. One of the points 72 is located adjacent where liquid is delivered to the aerosol generator, while the other point 74 is spaced laterally of where such liquid is delivered. In use, a build-up of unaerosolized liquid on aperture plate 20 will have no appreciable effect on electrical conductivity measured by a detector 76, until the unaerosolized liquid bridges the spacing between point 72,74. When the detector 76 registers a sudden change in conductivity—indicative of current flowing through unaerosolized liquid—the flow rate of liquid supply may be reduced to avoid further build-up of liquid. A second conductive sensor (not shown) may be positioned to detect when the amount of unaerosolized liquid falls below a lower level, for triggering an increase in liquid flow when required. In this way, conductivity may be used to maintain the amount of unaerosolized liquid supplied to the aerosol generator within certain limits.

In another embodiment, the conductive sensor 70 may be replaced with an optical sensor which, for example, senses the present or absence of unaerosolized liquid in a certain location, or series of discrete locations on the aperture plate. If the presence of unaerosolized liquid is sensed at an outer location spaced from the point of liquid delivery to the aerosol generator, the flow rate of liquid supply may be reduced. If the absence of unaerosolized liquid is sensed in another location spaced inwardly from the outer location, the flow rate of liquid supply may be increased.

Figure 4:
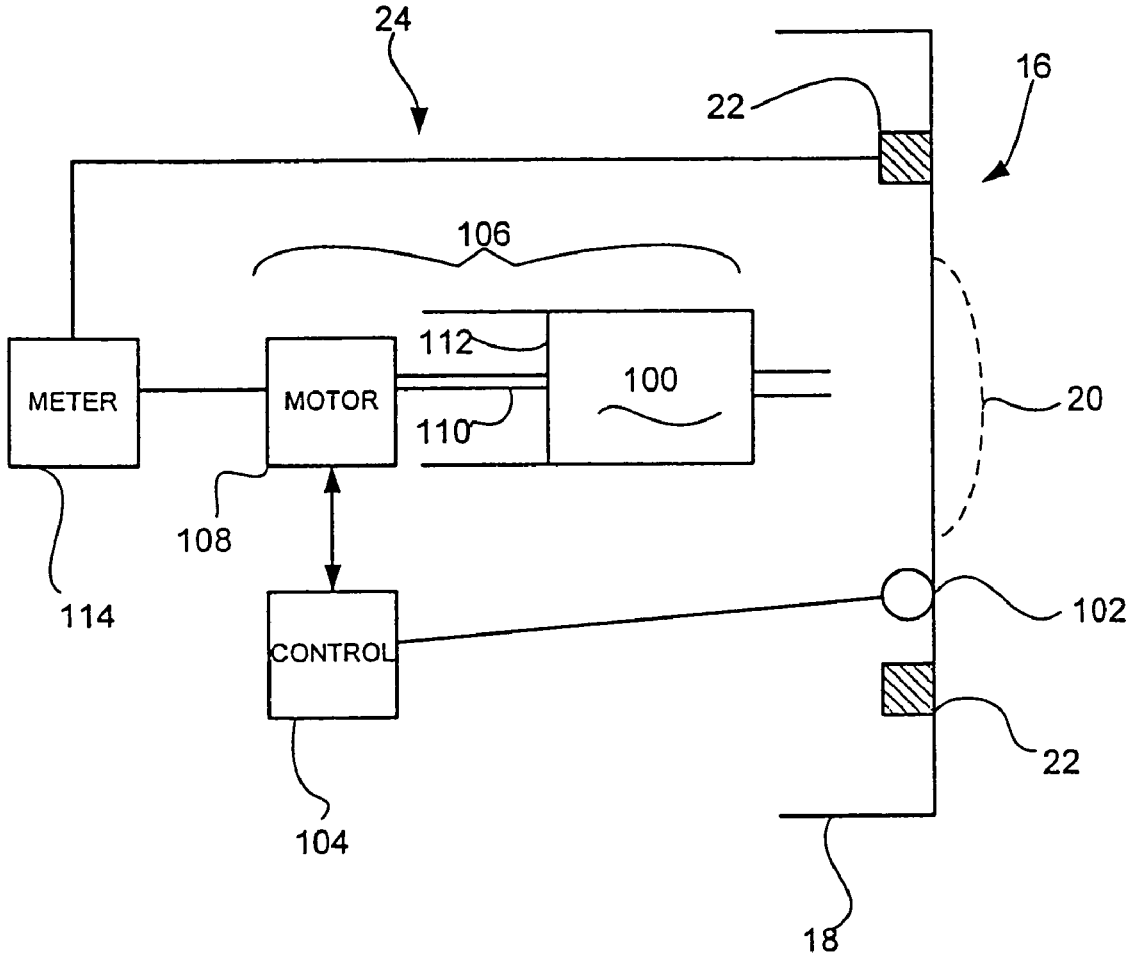
FIG. 4 is a schematic diagram of one embodiment of a liquid supply system according to the invention.

FIG. 4 schematically illustrates in more detail liquid feed system 24 of FIG. 1. Liquid feed system 24 includes a canister 100 configured to deliver liquid to aperture plate 20 of aerosol generator 16. A sensor 102 (be it piezo, conductive or optical) senses the unaerosolized liquid adhering to the aperture plate 20, and relays this information to controller 104. Controller 104 controls a dispensing system 106 which, upon receipt of dispensed signal from controller 104, dispenses a predetermined amount of liquid (e.g. 5 microliters) from canister 100. Dispensing system 106 comprises a motor 108 which drives a lead screw 110 coupled to a piston 112 associated with canister 100. When the controller 104 senses via sensor 102 that the amount of unaerosolized liquid on the aperture plate 20 has fallen below a lower limit, it activates motor 108 for a predetermined time, e.g. one second. In this time, motor 108 turns lead screw 110 causing piston 112 to advance a predetermined amount and hence deliver a measured quantity of liquid to the aerosol generator.

A meter 114 is coupled to the motor 108 and to the piezoelectric transducer 22. The meter 114 counts the number of times the motor 108 is activated in any period of continuous operation of the aerosol generator, i.e., while piezoelectric transducer 22 is vibrating. The meter 114 serves to prevent the motor 108 from being operated more than a predetermined number of times (e.g., 20) in any one period of use. In this way, the user may continue to use the aerosol generator 16 until an appropriate dose has been aerosolized (e.g., 20×5 microliters=100 microliters). At this time, operation of the motor 108 is temporarily stopped by the meter 114 and a corresponding signal sent to controller 104. Such a signal may enable an indication to be given to the user that a full dose has been delivered.

In some cases, the user may stop operation without aerosolizing the full dose. The controller may be configured to record the partial dosage and notify the user when attempting to continue operation.

Figure 5:
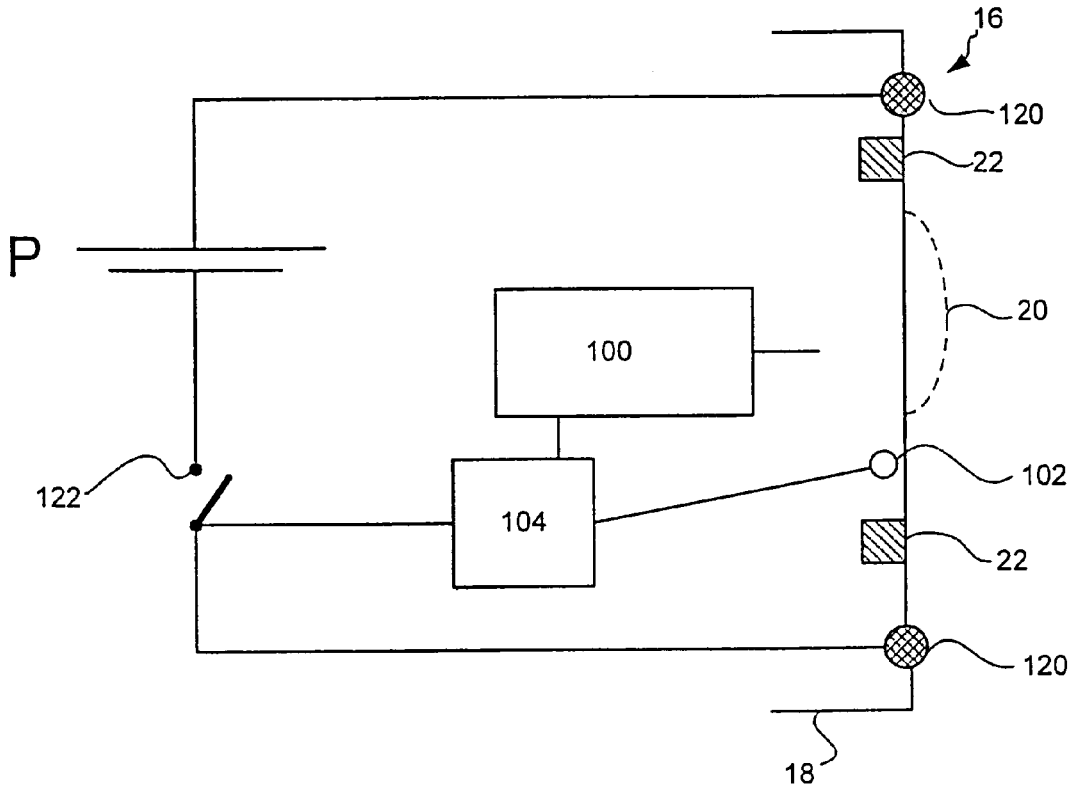
FIG. 5 is a schematic diagram showing a heater for an aerosol generator according to the invention.

FIG. 5 schematically illustrates a heater 120 for an aerosol generator, such as aerosol generator 16 of FIG. 1. Heater 120 is useful when unaerosolized liquid remains on the aperture plate 20 after the supply of liquid has ceased, e.g., because required dose has been delivered or the user stops operation. Heater 120 is incorporated into the aerosol generator 16 in order to vaporize or burn off excess unaerosolized liquid on the aperture plate 20. Heater 120 is an annular electrical resistance heater, and is energized by power source P under control of controller 104. In use, sensor 102 relays information to the controller 104 that unaerosolized liquid remains on the aperture plate 20 after the supply of liquid through supply system 100 has ceased. If this situation remains unchanged for a predetermined time interval, the controller 104 may activate switch 122 to heat aperture plate 20 by heater 120. In this way, excess unaerosolized liquid may be removed, ensuring the aperture plate 20 is clear and ready for reuse.

Figure 6:
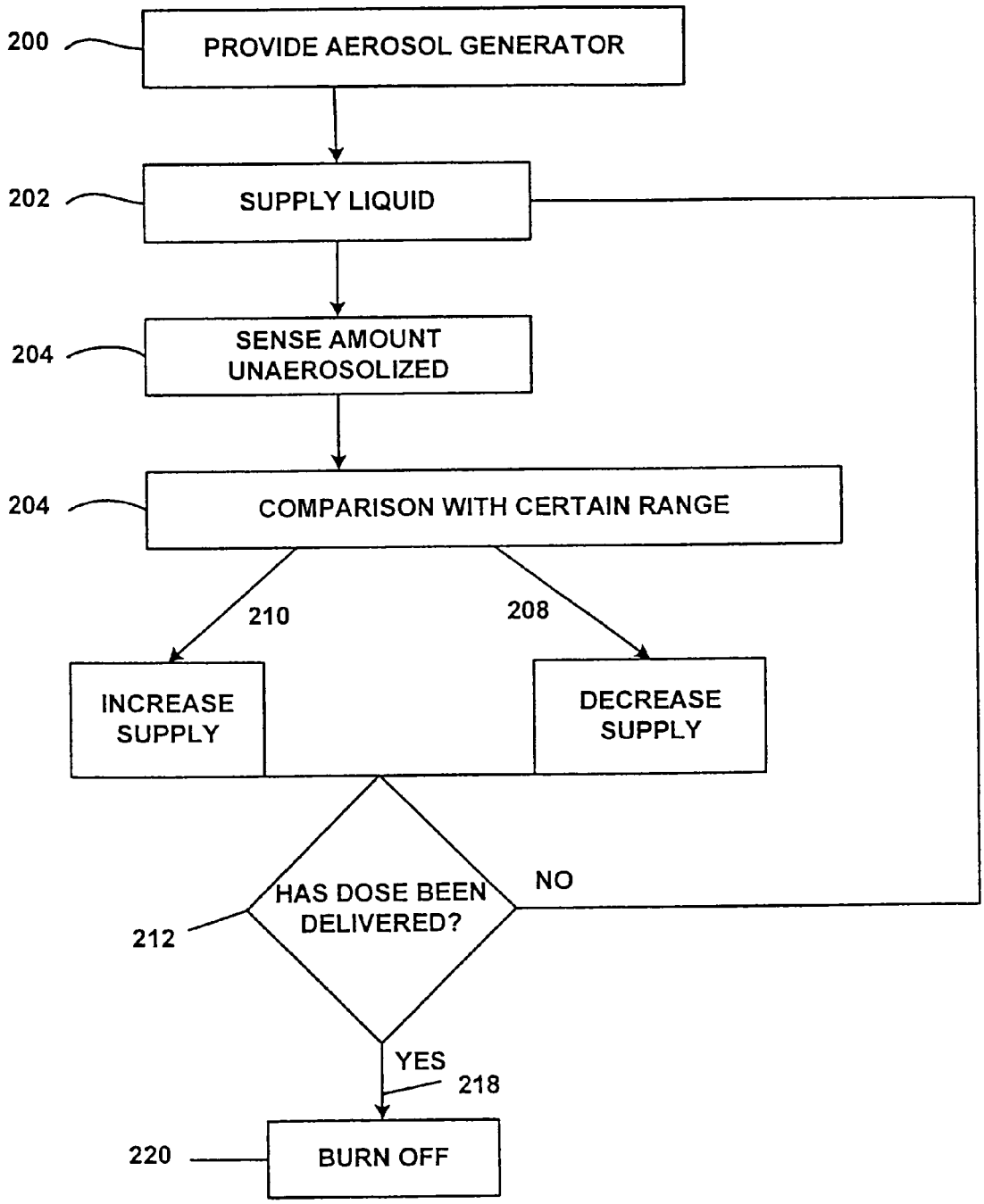
FIG. 6 is a flow chart illustrating one method of controlling the supply of liquid to an aerosol generator.
Figure 7:
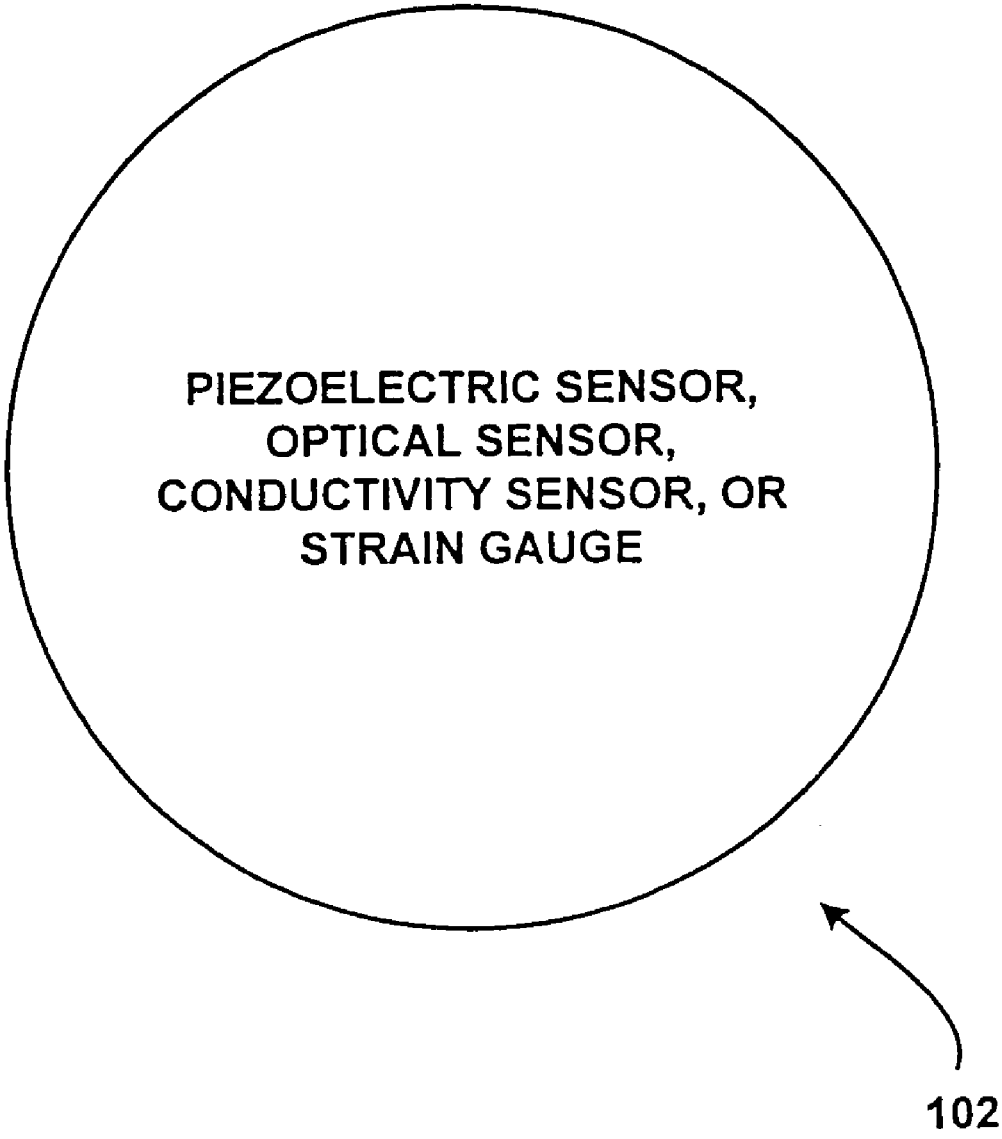
FIG. 7 is a drawing illustrating several embodiments of a fluid sensor according to the invention.
Figure 8:
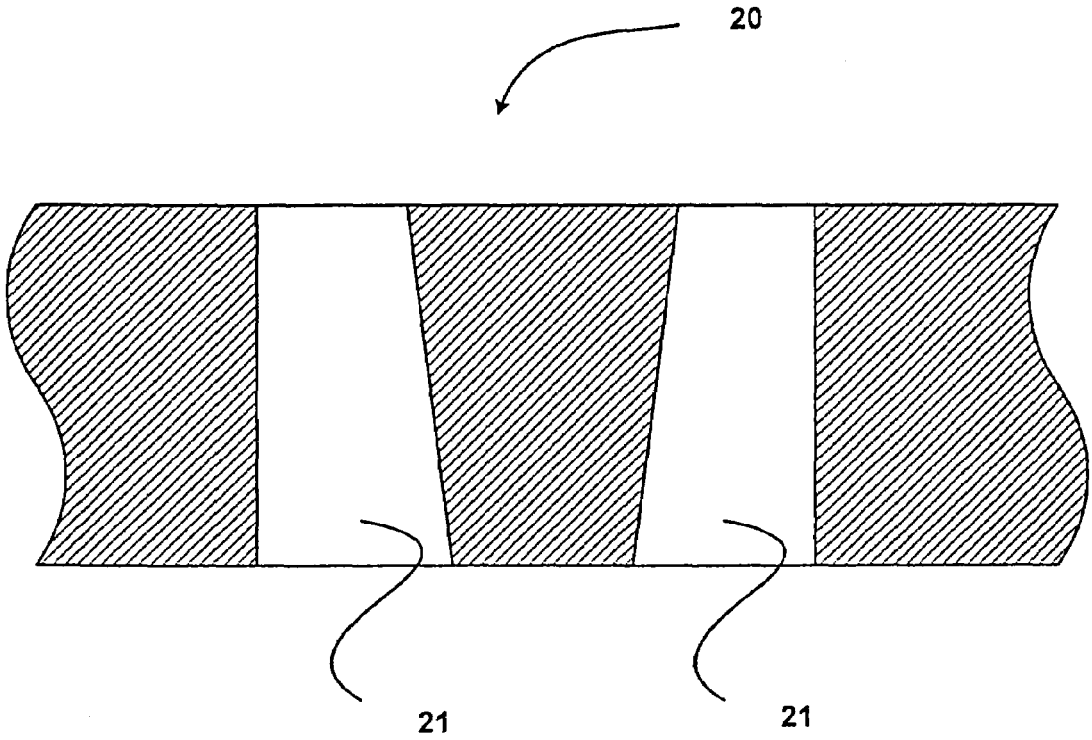
FIG. 8 is a cross-sectional diagram of an aperture plate according to one embodiment of the invention.

Referring now to FIG. 6, one method of controlling the supply of liquid to an aerosolizing device will now be described. The process begins at step 200 where an aerosol generator is provided. Liquid is supplied at step 202 to the aerosol generator for aerosolization. Some of the liquid supplied is unaerosolized and accumulates on the aerosol generator, and the amount of such liquid is sensed as shown at step 204. The amount of liquid sensed is then compared at step 206 with a predetermined range of amounts, the upper limit of which corresponds to the maximum desired amount on the aerosol generator, and the lower limit of which corresponds to the minimum desired amount on the aerosol generator. If the sensed amount exceeds the upper limit, the flow rate is decreased at step 208, and if the sensed amount falls below the lower limit, the flow rate is increased as shown at step 210. The total amount of liquid supplied to the aerosol generator is monitored at step 212. If the total amount is less than a predetermined total dose, the supply cycle is repeated, and if the total amount is equal to the predetermined dose, the supply is terminated at step 218. Any unaerosolized liquid on the aerosol generator after terminating the supply is burnt off at 220 by energizing an electric heater.

The invention has now been described in detail for purposes of clarity of understanding. However, it will be appreciated that certain changes and modifications may be practiced within the scope of the appended claims.

What is claimed:

1. An aerosolization device comprising:

a liquid supply system that is adapted to hold a supply of liquid;

an aerosol generator configured to aerosolize liquid supplied from the liquid supply system by ejecting the liquid through tapered apertures in an oscillating surface wherein the liquid is ejected through the apertures without the need for fluid pressure:

a sensor that is configured to sense an amount of unaerosolized liquid supplied to the aerosol generator; and a controller to control operation of the liquid supply system based on information received from the sensor;

wherein the sensor comprises a strain gauge coupled to the aerosol generator for detecting variations in strain according to variations in the amount of unaerosolized liquid in contact with the aerosol generator.

2. An aerosolization device according to claim 1, wherein the strain gauge comprises a piezoelectric element, with variations in the amount of unaerosolized liquid adhered to the aerosol generator causing corresponding variations in an electrical characteristic of the piezoelectric element.

3. An aerosolization device according to claim 2, further comprising electrical circuitry configured to measure variations in impedance of the piezoelectric element.

4. An aerosolization device according to claim 2, wherein the piezoelectric element is disposed to vibrate the oscillating surface in the aerosol generator.

5. An aerosolization device comprising:

a liquid supply system that is adapted to hold a supply of liquid;

an aerosol generator configured to aerosolize liquid supplied from the liquid supply system by ejecting the liquid through tapered apertures in an oscillating surface wherein the liquid is ejected through the apertures without the need for fluid pressure;

a sensor that is configured to sense an amount of unaerosolized liquid supplied to the aerosol generator; and a controller to control operation of the liquid supply system based on information received from the sensor;

wherein the sensor comprises a conductive sensor configured to sense electrical conductivity between at least two points across a surface of the aerosol generator on which supplied and unaerosolized liquid adheres, at least one point being spaced from where liquid is supplied to the aerosol generator.

6. An aerosolization device according to claim 5, wherein one of the at least two points is closer to where liquid is supplied to the aerosol generator than another of the at least two points.

7. An aerosolization device comprising a liquid supply system that is adapted to hold a supply of liquid;

an aerosol generator configured to aerosolize liquid supplied from the liquid supply system by ejecting the liquid through tapered apertures in an oscillating surface wherein the liquid ejected through the apertures without the need for fluid pressure;

a housing having a mouthpiece, the aerosol generator being disposed in the housing for delivery of aerosolized liquid through the mouthpiece;

a sensor that is configured to sense an amount of unaerosolized liquid supplied to the aerosol generator; and a controller to control operation of the liquid supply system based on information received from the sensor.

* * * * *